US005481880A

United States Patent [19]

Guillard et al.

[11] Patent Number: 5,481,880

[45] Date of Patent: Jan. 9, 1996

[54] PROCESS AND ASSEMBLY FOR THE COMPRESSION OF A GAS

[75] Inventors: Alain Guillard, Paris; Bernard Saulnier, Colombes, both of France

[73] Assignee: L'Air Liquide, Societe Anonyme pour l'Etude et l'Exploitation des Procedes Georges Claude, Paris, France

[21] Appl. No.: 307,001

[22] Filed: Sep. 16, 1994

[30] Foreign Application Priority Data

Sep. 21, 1993 [FR] France ..... 93 11232

[51] Int. Cl.[6] ..... F25J 3/00

[52] U.S. Cl. ..... 62/9; 62/40; 62/44; 165/900

[58] Field of Search ..... 62/9, 40, 44; 165/900

[56] References Cited

U.S. PATENT DOCUMENTS

| | | | |
|---|---|---|---|
| 2,333,748 | 11/1943 | Sperry | 62/9 X |
| 2,708,831 | 5/1955 | Wilkinson | 62/40 X |
| 3,094,133 | 6/1963 | Treanor | 165/900 X |
| 3,144,316 | 8/1964 | Koehn et al. | 62/9 |
| 3,358,748 | 12/1967 | Christopher | 165/900 X |
| 3,677,019 | 7/1972 | Olszewski | 62/9 |
| 3,722,226 | 3/1973 | McDermott et al. | 62/13 |
| 3,851,495 | 12/1974 | Lahoud et al. | 62/260 X |
| 4,054,623 | 10/1977 | Ouska | 165/900 X |
| 4,315,404 | 2/1982 | Schmitt et al. | 165/900 X |
| 5,231,835 | 8/1993 | Beddome et al. | 62/9 |

FOREIGN PATENT DOCUMENTS

| | | | |
|---|---|---|---|
| 560692 | 5/1958 | Belgium | 62/9 |
| 2284848 | 4/1976 | France | 165/900 |
| 2550908 | 5/1977 | Germany . | |
| 18395 | 1/1984 | Japan | 165/900 |
| 93298 | 5/1985 | Japan | 165/900 |
| 1070635 | 3/1989 | Japan | 165/900 |

*Primary Examiner*—Christopher Kilner
*Attorney, Agent, or Firm*—Young & Thompson

[57] ABSTRACT

Cooling water for compression apparatus (1) is cooled by an air-refrigerated apparatus (18). Makeup water which is cooler than the water treated by this apparatus passes first through a heat exchanger (8) mounted on the delivery conduit of the compression apparatus, then supplies the refrigeration apparatus (18). Use in air distillation installations.

14 Claims, 1 Drawing Sheet

PROCESS AND ASSEMBLY FOR THE COMPRESSION OF A GAS

FIELD OF THE INVENTION

The present invention relates to a process for the compression of a gas, of the type in which there is supplied makeup water to an air refrigerated apparatus for the cooling water of the compression apparatus of the gas. It is applicable particularly to the various compression apparatus which are components of the installations for the distillation of air.

BACKGROUND OF THE INVENTION

In installations for the distillation of air, atmospheric air is compressed to 6 bars absolute by a several-stage compressor. Each intermediate stage comprises an intermediate heat exchanger, a so-called "interstage cooler", and the last stage comprises a heat exchanger called a "final cooler". These exchangers are generally supplied by water which comes from the air-cooled apparatus, which treats the water returned from the exchangers.

Because of the evaporation of a portion of the water in the refrigeration apparatus and the need to effect purges of the circuit, this apparatus is supplied with a makeup water flow, which usually comes from an underground water supply.

The water treated by the cooling apparatus will be at a temperature that varies seasonally, as a function of the air temperature. At least in the warm season, it will generally not permit lowering the air temperature from the last compressor stage below 25° to +30° C. To optimize the apparatus for purification by adsorption by reducing the quantity of adsorbent needed, there is positioned between the final cooler and the adsorption apparatus a refrigeration group, or another auxiliary cooling apparatus, so as to lower the temperature of the compressed air, typically to below +15° C.

The air distillation systems generally comprise other compression apparatus, also cooled by water from the mentioned circuit: an air supercharger mounted downstream of the principal compressor, generally coupled to an air expansion turbine, and/or a nitrogen cycle compressor. These compression apparatus generally feed cryogenic cooling exchangers, and it would be interesting to precool in a more rapid way the gas which they receive, for example to increase the production of liquid.

However, in these compression apparatus as in the principal air compressor, the reduction of the temperature of the compressed gas, at least in the warm season, below about 25° C., requires the use of a refrigeration group or of another auxiliary apparatus, whose cost and maintenance expense is not negligible.

SUMMARY OF THE INVENTION

The invention has for its object to permit reducing the temperature of the compressed gas without having recourse to a refrigeration group or other auxiliary apparatus, and this in a particularly economical way.

To this end, the invention has for its object a process for the compression of a gas, of the type recited above, characterized in that at least when the makeup water is cooler than the water treated by the refrigeration apparatus, the makeup water is placed in heat exchange relation with the gas that is output by the last stage of the compression apparatus, then the makeup water is sent to the refrigeration apparatus.

This process can comprise one or several of the following characteristics:

- the gas that is output by the last stage of the compression apparatus can be placed in heat exchange relation first with the water treated by the refrigeration apparatus, then with the makeup water;
- the gas that is output by the last stage of the compression apparatus can be placed directly in heat exchange relation with the makeup water;
- the compression apparatus is the principal air compressor of an air distillation installation, the air cooled by heat exchange with the makeup water being directly sent to an apparatus for the purification of air by adsorption or to the principal heat exchange line of this installation;
- the compression apparatus is an air supercharger of an air distillation installation, the air cooled by heat exchange with the makeup water being sent to the warm end of the principal heat exchange line of this installation;
- the compression apparatus is a nitrogen cycle compressor of an air distillation installation, the nitrogen cooled by heat exchange with the makeup water being sent to the warm end of a heat exchanger for the liquefaction of nitrogen of this installation;
- there is used for said heat exchange a flow of makeup water which is more than the need of the refrigeration apparatus, and the makeup water is compensated by purging from this apparatus and/or by evacuation of makeup water upstream of this apparatus.

The invention also has for its object an assembly for the compression of a gas adapted to practice such a process. This assembly, of the type comprising a compression apparatus associated with a cooling circuit for water comprising an apparatus for the refrigeration of air with return water, and a supply conduit of the refrigeration apparatus for makeup water, is characterized in that the supply conduit for makeup water passes through a heat exchanger mounted on the output conduit of the last stage of the compression apparatus, before reaching the refrigeration apparatus.

In an embodiment of this compression assembly, the supply conduit of makeup water comprises a selective bypass of the connections of the heat exchanger, and there is provided means to supply selectively this exchanger with water treated by the refrigeration apparatus.

BRIEF DESCRIPTION OF THE DRAWINGS

Examples of embodiment of the invention will now be described with respect to the accompanying drawing, in which.

DETAILED DESCRIPTION OF THE INVENTION

Figure 1:
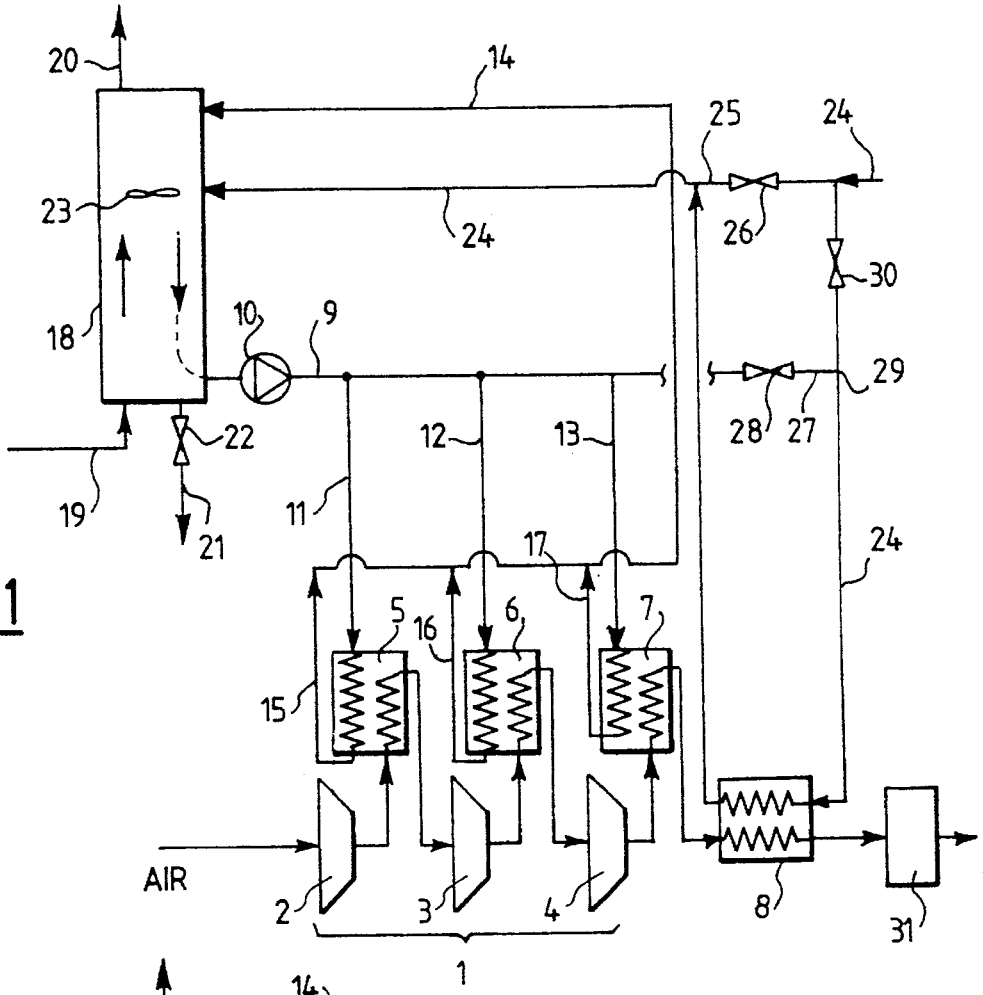
FIG. 1 shows schematically an air compressor assembly according to the invention.

There is shown in FIG. 1 the principal air compressor 1 of an air distillation installation, which can be moreover of known type, for example for a double distillation column.

The compressor 1 comprises three stages 2 to 4 and is associated with four heat exchangers of the indirect countercurrent type. A first interstage cooler 5, a second interstage cooler 6, a "final" cooler 7, and a precooling heat exchanger 8.

A water cooling circuit associated with the compressor 1 comprises: a supply conduit 9 for cool water, provided with a circulation pump 10 and from which leave three branches 11 to 13 which open respectively at the cold end of the exchangers 5 to 7; a return conduit 14 for water, into which open three conduits 15 to 17 from respectively the warm ends of exchangers 5 to 7; and a refrigeration tower 18 supplied at its head by the conduit 14 and supplying at its base the conduit 9.

The tower 18 comprises at its base an atmospheric air inlet 19 and at its top an outlet 20 for heated and humidified air. It also comprises at its base a purge conduit 21 provided with a valve 22, and it is provided with a member 23 for causing ascending circulation of cooling air.

The circuit described above is completed by a supply conduit 24 for makeup water connected via a pump or a water tower (not shown) to an underground water supply. This conduit passes first through the exchanger 8, from its cold end to its warm end, then is connected to the tower 18. It moreover comprises a bypass 25, provided with a valve 26, to the connections of exchanger 8. The conduit 9, after its branch 13, is prolonged by a section 27 provided with a valve 28 and opens into a point 29 in the conduit 24 adjacent the cold end of the exchanger 8. Another valve 30 is provided in the conduit 24 between the bypass 25 and the point 29.

In the warm season, atmospheric air, at +25° to +30° C. for example, does not permit the tower 18 to cool the water, according to the water content of the air, below about +25° to +35° C. The compressed air therefore leaves the exchanger 7 at +30° to +40° C.

On the other hand, the makeup water withdrawn from an underground source is at a relatively stable temperature all year, for example comprised between +5° and +15° C. By circulating first through the exchanger 8, it therefore lowers the temperature of the compressed air to +10° to +20° C., which is favorable for water and carbon dioxide removal by adsorption and permits, for the price of a simple heat exchanger 8, avoiding the use of a refrigeration group or other precooling apparatus downstream of the exchanger 7. The air leaving the exchanger 8 is thus directly sent to the apparatus 31 for purification by adsorption.

The makeup water leaves the exchanger 8 at +15° to +25° C. and then supplies the tower 18, to compensate the evaporation of water in this latter as well as the flow of purge withdrawn at 21.

It is to be noted that the temperature rise of the makeup water, relative to a conventional arrangement in which it would directly supply the tower 18, has a negligible influence on the performance of this tower, because its flow rate represents only several percent of the total flow rate of refrigerated water.

In the cold season, the atmospheric air can be sufficiently cold that the water treated in 18 will be cooled below +15° C., and more precisely to a temperature at least as low as that of the makeup water. In this case, the valve 30 is closed and the valves 26 and 28 are opened. The makeup water then supplies the tower 18 directly, and it is the circulating water from this latter which supplies the exchanger 8.

As a modification, the conduit section 27 could moreover be omitted, because in such a case, the exchanger 7 operates under the same conditions as the exchanger 8.

Figure 2:
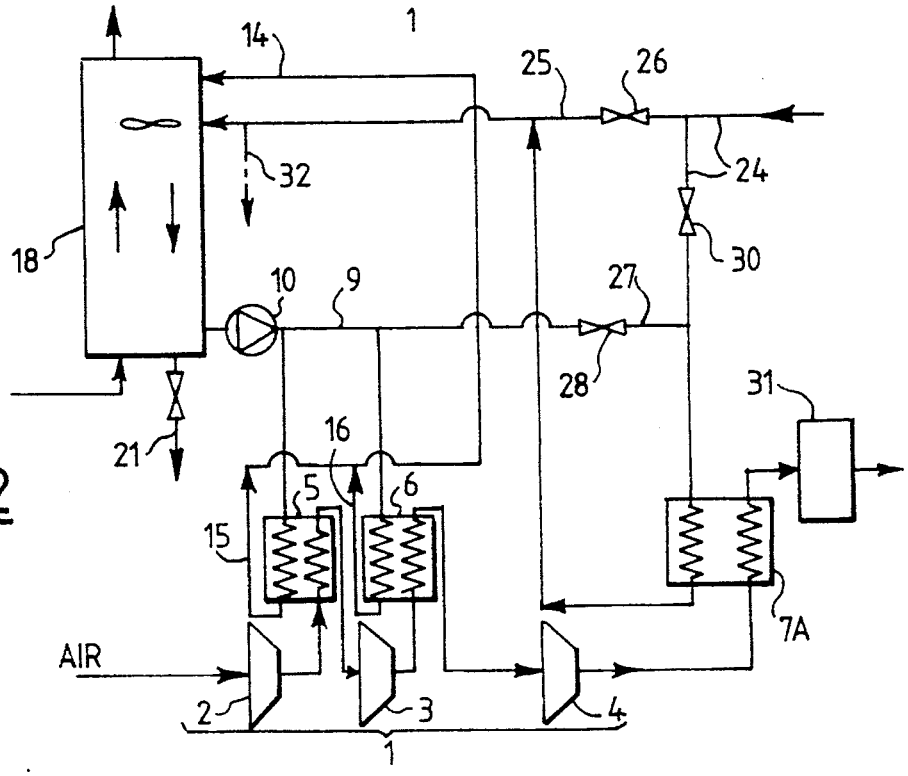
FIG. 2 is a similar view of a modification.

The modification of FIG. 2 differs from that of FIG. 1 only by the combination of the exchangers 7 and 8 as a single exchanger 7A, supplied by the conduit 24. Thus, in the warm season, the air compressed in 4 is directly cooled by the makeup water, before the latter is sent to the tower 18. The air leaving the exchanger 7A is then directly sent to the apparatus 31 for purification by adsorption, as before. Of course, in the cold season, the bypass 25 permits, as explained above, sending directly the makeup water to tower 18 and cooling the exchanger 7A by means of the water circulating in the conduit 9.

As will be understood, the modification of FIG. 2 requires a relatively large flow rate of makeup water to cool the exchanger 7A. If this flow rate is excessive with respect to the requirements of the tower 18, either the flow rate of the purge at 21 can be increased, or else excess makeup water can be sewered or otherwise evacuated from the installation upstream of the tower 18, as shown in broken line at 32. This applies also to the embodiment of FIG. 1.

The cooling of a compressed gas by makeup water in an air cooled tower, according to one or the other of the embodiments described above, can also be used with other compression apparatus for air distillation installations. Thus, in the case of an air supercharger or a nitrogen refrigeration cycle compressor, this cooling technique permits in an economical way lowering substantially the temperature of the compressed gas before its entry into the cryogenic heat exchange line which follows. This permits for example increasing the production of liquid.

Moreover, in each case, the inlet temperature of the gas compressed in the heat exchange line which follows will thus be adjusted. This applies particularly to the case in which, in FIG. 1, there is provided as a supplement to the exchanger 8 or another precooling apparatus mounted in place of this exchanger, a heat exchanger cooled by makeup water, mounted between the outlet of the purification apparatus 31 and the warm end of the principal heat exchange line of the distillation installation.

The tower 18 can be specifically associated with compressors to be cooled, or else it can serve at the same time to cool the cooling water of other apparatus at the site, for example in an arc furnace supplied with oxygen by the air distillation installation.

We claim:

1. A process for the compression of a gas, comprising:

compressing said gas by passing said gas to a first stage of a compression apparatus having a plurality of fluidly connected stages, withdrawing a compressed gas from a last stage of said compression apparatus, providing a water cooling circuit operatively associated with said compression apparatus, said water cooling circuit including an air refrigeration apparatus, refrigerating return water with air in said refrigerating apparatus, and supplying said air refrigeration apparatus with makeup water by initially placing said makeup water in heat exchange relation with said compressed gas from the last stage when said makeup water is cooler than said return water, and then sending the makeup water to said refrigeration apparatus.

2. A process according to claim 1, further comprising first placing the compressed gas from the last stage of the compression apparatus in heat exchange relation with the return water treated by the refrigeration apparatus, then in said heat exchange relation with the makeup water.

3. A process according to claim 1, wherein the compressed gas from the last stage of the compression apparatus is placed in direct heat exchange relation with the makeup water.

4. A process according to claim 1, wherein the gas being compressed is air, and the compression apparatus is a primary air compressor of an air distillation installation, and wherein air cooled by heat exchange with the makeup water is sent directly to an air purification adsorption apparatus, or to a principal heat exchange line of said distillation installation.

5. A process according to claim 1, wherein the gas being compressed is air and the compression apparatus is an air supercharger of a distillation installation, and wherein the air cooled by heat exchange with the makeup water is sent to a warm end of a principal heat exchange line of said distillation installation.

6. A process according to claim 1, wherein the gas being compressed is nitrogen, and the compression apparatus is a nitrogen cycle compressor of an air distillation installation, and wherein nitrogen cooled by heat exchange with the makeup water is sent to a warm end of a nitrogen liquefaction heat exchanger of said air distillation installation.

7. A process according to claim 1, wherein excess makeup water is disposed by purging from said refrigeration apparatus, or by evacuating makeup water upstream of said refrigeration apparatus.

8. An assembly for the compression of a gas, comprising:

a compression apparatus including a plurality of fluidly and serially connected stages, wherein a first stage includes an inlet for said gas, and a last stage having an output conduit, a water cooling circuit operatively associated with said compression apparatus and including air refrigeration apparatus for refrigerating return water with air, and a supply conduit for supplying the refrigeration apparatus with makeup water, said supply conduit passing through a heat exchanger mounted on the output conduit of the last stage of the compression apparatus before reaching the refrigeration apparatus.

9. An assembly according to claim 8, wherein the water cooling circuit comprises a preheat exchanger supplied with water treated by the refrigeration apparatus, said preheat exchanger being fluidly connected to said output conduit between the compression apparatus and said heat exchanger.

10. An assembly according to claim 8, wherein said heat exchanger is mounted directly on the output conduit of the last stage of the compression apparatus.

11. An assembly according to claim 8, wherein the supply conduit for makeup water further comprises a selective bypass conduit bypassing said heat exchanger, and means for selectively supplying said heat exchanger with water treated by the refrigeration apparatus.

12. An assembly according to claim 8, wherein the compression apparatus is a primary air compressor of an air distillation installation, said heat exchanger being disposed between said air compressor and an air purification adsorption apparatus of the distillation installation.

13. An assembly according to claim 8, wherein the compression apparatus is an air supercharger of an air distillation installation, said heat exchanger being disposed between said supercharger and a warm end of a primary heat exchange line of the air distillation installation.

14. An assembly according to claim 8, wherein the compression apparatus is a nitrogen cycle compressor of an air distillation installation, said heat exchanger being disposed between said nitrogen compressor and a warm end of a heat exchanger for liquefaction of nitrogen in said air distillation installation.

* * * * *